US007262356B1

(12) United States Patent
Lukios, II

(10) Patent No.: US 7,262,356 B1
(45) Date of Patent: Aug. 28, 2007

(54) BASS DRUM PEDAL HYPER-BEATER

(76) Inventor: Charles Dean Lukios, II, 2085 N. Del Mar Ave., San Marino, CA (US) 91108-2809

( * ) Notice: Subject to any disclaimer, the term of this patent is extended or adjusted under 35 U.S.C. 154(b) by 0 days.

(21) Appl. No.: 11/405,905

(22) Filed: Apr. 18, 2006

(51) Int. Cl.
*G10D 13/02* (2006.01)

(52) U.S. Cl. ..... 84/422.1; 84/422.1; 84/422.2; 84/411 R

(58) Field of Classification Search ..... 84/411 R, 84/422.1, 422.3
See application file for complete search history.

(56) References Cited

U.S. PATENT DOCUMENTS

| | | | | | |
|---|---|---|---|---|---|
| 800,509 | A * | 9/1905 | Stanton | 84/422.1 |
| 965,435 | A * | 7/1910 | Brauer | 84/104 |
| 994,289 | A * | 6/1911 | Unger, Jr. | 84/422.1 |
| 1,385,898 | A * | 7/1921 | Angyal | 84/422.1 |
| 3,195,391 | A * | 7/1965 | Peters | 84/422.1 |
| 3,750,517 | A * | 8/1973 | Sleishman | 84/422.1 |
| 5,567,899 | A * | 10/1996 | Hoshino | 84/422.1 |
| 5,578,777 | A * | 11/1996 | Lombardi | 84/422.1 |
| 5,591,929 | A * | 1/1997 | Wellman | 84/422.1 |
| 5,627,332 | A * | 5/1997 | Lombardi | 84/422.1 |
| 5,767,428 | A * | 6/1998 | Bloch | 84/422.1 |
| 5,789,688 | A * | 8/1998 | Schiano | 84/422.1 |
| 5,798,472 | A * | 8/1998 | Shigenaga | 84/422.1 |
| 5,990,401 | A * | 11/1999 | Braun et al. | 84/422.1 |
| 6,002,076 | A * | 12/1999 | Karn | 84/422.1 |
| 6,255,574 | B1 * | 7/2001 | Sapienza | 84/422.1 |
| 6,278,046 | B1 * | 8/2001 | Sikra et al. | 84/422.1 |
| 6,307,136 | B1 * | 10/2001 | Sikra et al. | 84/422.1 |
| 6,541,686 | B2 * | 4/2003 | O'Donnell | 84/422.1 |
| 6,632,990 | B2 * | 10/2003 | Menzel et al. | 84/422.1 |
| 6,649,820 | B2 * | 11/2003 | Sassmannshausen | 84/422.1 |
| 6,689,945 | B1 * | 2/2004 | Matsuzoe et al. | 84/422.1 |
| 6,734,350 | B2 * | 5/2004 | Sleishman | 84/422.1 |
| 6,924,422 | B2 * | 8/2005 | Wise | 84/422.1 |
| 6,979,770 | B2 * | 12/2005 | Hampton, Jr. | 84/723 |
| 2003/0000367 | A1 * | 1/2003 | Sleishman | 84/422.1 |
| 2004/0074372 | A1 * | 4/2004 | Studer | 84/411 R |

* cited by examiner

*Primary Examiner*—Lincoln Donovan
*Assistant Examiner*—Robert W. Horn
(74) *Attorney, Agent, or Firm*—Joseph E. Mueth

(57) ABSTRACT

A drum pedal assembly having a base plate with provisions to attach to a floor surface having a forward end to be juxtaposed with a drum and an aft end with both pedals hinged on the same base plate aft end, a pair of posts that are affixed at the base plate forward end that are parallel and vertical. Respective bearings, springs, drive shafts and bearing housings supported by fittings on the housings journaled over the posts. A similar secondary assembly placed to the right or left of the above-mentioned, driving a single beater and two beaters driven by the primary pedal. Independent linkages attach each pedal to its respective beater(s). The primary pedal system causes two beaters to strike the drum (on center) in an upstroke movement as well as a down stroke movement, the secondary beater striking on depression of the pedal.

12 Claims, 3 Drawing Sheets

BASS DRUM PEDAL HYPER-BEATER

FIELD OF THE INVENTION

The present invention relates to a drum pedal. In particular, this conception relates to a multiple pedal, multiple beater drum pedal.

BACKGROUND OF THE INVENTION

U.S. Pat. No. 5,421,235 of Lombardi describes a double bass-drum pedal whereas a set of two separate pedals each operating their own respective beaters that are placed together in parallel on uncommon shafts to a common base plate. This base plate is the foundation of one of the pedals with posts, one of being formed as a 'Y' to provide a central pivot point for the two individual axial shafts. One of which supports a spring bellcrank and beater mounting. The other only carries a beater mount. The other shaft is coupled by a connection rod and two universal joints to a shaft on the primary pedal assembly. This pedal is separated by it's own base plate pivots and shaft, common in connection with one of the universal joints. This auxiliary pedal carries it's own spring and bellcrank.

In the U.S. Pat. No. 20020121177 of Sassmannhausen, the pedal is configured to operate whereby the toe (forward) section of pedal actuates one of the two parallel placed beaters. The other beater being actuated by the heel section (aft) of the pedal independently from each other. The moving components are therefore complex in that they require additional manufacturing processes and components. This pedal design requires the operator to manipulate the pedal in a somewhat rocking motion that is not as ergonomic as this invention application.

OBJECTS OF THE INVENTION

The objective of this invention is to sustain as close to the same amount of energy applied to the upward stroke of the pedal as is to the down stroke of the pedal, therefore similar note projection can be attained.

A further object is that this movement is also more ergonomic as is more of a simple design with fewer moving parts.

An additional object is that this invention has it's primary and secondary pedal directly adjacent to each other on the same base plate. This is so as to free the operator's other foot to operate an additional drum/pedal assembly or other foot operated instrument.

In addition to this opposed double beater design is placed a single secondary system directly adjacent to the primary double beater assembly. This secondary pedal can be removed by separation of it's connecting hardware to be placed directly to the left or right of the primary pedal. Additionally, this secondary pedal can be separated from the base plate to add an additional double beater or single beater than can be interchanged as desired by the operator.

An additional object is that this invention is made with components and materials that are aircraft grade or used in aircraft fabrication which will positively increase the reliability and serviceability of the invention.

The most important object is that physically impaired or disabled individuals will benefit their performance and comfort in the arts of bass drumming to a higher level.

SUMMARY OF THE INVENTION

This apparatus has a base plate that attaches to a larger base floor surface. The base plate having a forward end to be juxtaposed with a drum and an opposed aft end with pedals hinged on the base plate aft end. A set of square cross sectioned posts having upper and lower ends with the lower end of the posts positively fixed to the base pate forward end. They are generally parallel and vertical. A cross member placed toward the top of the posts which provide lateral and vertical stability which interconnect the two posts. It also provides to affix the unit to the top end of drum after in position, this cross member is locked onto the top end of drum rim with the cross members integral locking clamp system, while the bottom end of drum clamps to the base plate. A set of drive shafts that are affixed perpendicular to the posts. The two shafts for the primary system are placed one toward the top and other toward the bottom of the post's elevation. They are supported by bearings on each end, bearings are supported by housings that are fixtured by brackets that are sleeved around the posts and held in the adjusted positions by lock screws.

An additional secondary drive shaft, half the length of the primary shaft placed just above the primary bottom shaft in the same fashion as the primary shaft. All three shafts are accompanied by spring biasing mechanisms.

The pedals are linked to the drive shafts that are comprised of spherical rod bearings threaded onto rods that are threaded to turn-barrels. The opposite end of the turn-barrels continue upward in the same fashion as to the pedals in connection to their respective bell cranks. The bearing joints, rods and turn-barrels provide a higher advantage of adjustment.

The beaters (one mounted on each drive shaft) are placed (for primary system) so that when the pedal is depressed, one beater will strike the drum and when the pedal is raised, the other beater strikes the drum. Both beaters are arranged to strike the drum's center of head.

The primary pedal features a toe strap system whereby additional upward force can be applied to an upstroke so that similar sound projection and speed can be achieved.

Included in this invention is a secondary pedal/beater system that is placed adjacent to the primary pedal/beaters system that is of conventional design and action. The pedals and linkages can be placed to the right or left of each other on the base plate.

SPECIFIC DESCRIPTION

As illustrated in FIG. 1, a drum pedal assembly consisting of a base plate 1 with provisions to attach this plate to a larger area surface of sufficient size so as to place the operators seat and drum 2 onto this surface (such as a sheet of plywood).

Two pedals 3, 4, hinged 5, 6, onto this base plate and attached with an adjustable provision thereby the use of elongated holes 7, with fasteners incorporated in the base plates aft end. The base plate also incorporates four holes, (one at each approximate corner) so that the base plate can be attached to the playing surface floor with appropriate fasteners.

On the forward end of the base plate, contains the lower drum rim clamp. It secures the bottom edge of the drum to the assembly and is placed between the two posts. To the right and left sides of the base plate and pedals are the two posts 8, 9, that are of square cross section attached at the forward end of the base plate extending vertically. The upper ends of the posts are supported by a cross member 10 this is of similar cross section. The cross member has attached to it at each end, cross member brackets 11, 12. The brackets are positioned/welded so as to journal over each post and allowed to move up/down on the elevation of the posts. When the cross member is adjusted properly for drum diameter, it is then secured by jam screws 13, contained in the cross member brackets. Additionally, the cross member contains an upper drum hoop attachment clamp 14, that is placed at midpoint between the ends of the cross member. This clamp serves to attach the upper end of the assembly. The clamp is attached to the cross member via an upper hoop clamp hinge 15. The hinge is attached to the cross member by an upper hoop clamp bracket 16, that is journaled over the cross member and is held in its lateral adjustment via a jam screw contained in the upper hoop clamp bracket. The upper hoop clamp hinge allows for an extra provision of adjustment to accommodate various drum hoop profiles.

Directly below the cross member and parallel to it is the upper drive shaft 17. It is of round cross section and is supported by each post via bearings, bearing housings and bearing housing brackets. The drive shaft is journaled through each bearing inner race. Bearings are held in place by the bearing housings 18. The bearing housings are held onto each post via bearing housing fittings 19. They are of the similar construction as those of the cross member fittings. The bearing housing fittings are held in position by a jam screw on each fitting on the lower end of the posts.

Positioned just above the pedals is the lower drive shaft 20. It is of the same construction as the upper drive shaft with also the same supporting system as the upper drive shaft system. The primary pedal as arranged in FIG. 1, is linked to the drive shafts via a linkage system. This linkage system consists of a pedal link fitting 12, hemispherical rod ends 22, link rod(s) 23, turn barrel(s) 24 and bell crank(s) 25.

Attached to the forward end of the primary pedal is a fitting that attaches the hemisphere bearinged rod end. The rod end(s) is threaded onto the link rod and when adjusted properly is locked in position via a jam nut 26. The rod end bearing as well as the remaining complement of rod ends bearings are attached to the fittings with the use of bolts and locking nuts. These bolt/nuts are tightened against their inner races to the fittings.

From the pedal rod end, upward is the link rod that attaches to a turn barrel 24. Turn barrels are threaded internally on both ends. One end of each turn barrel and rod link is reverse threaded so that when the turn barrel is turned to adjust, the link group can either be extended or shortened to the correct propagation. When the links are adjusted properly, they are then locked in position by the use of jam nuts.

The uppermost rod end of the primary inboard link is attached to the upper drive shaft with the use of an upper inboard bell crank 27. This bell crank is journaled over the upper drive shaft somewhat between the outboard upper bell crank 28 and the upper beater shaft fitting 29.

FIG. 2 illustrates in more detail the construction of the bell crank(s). The bell crank throws have a feature that allows the rod end attachment points to be adjustable, (stroke can be increased/decreased). The bell crank features include serrations on one side of the throw surface along the length of the elongated slot. These serrations are designed to lock together with the serrated washer. When tightened together, the throw, washer, rod end and bolt/locknut, will not change its selected position during the pedal's use.

On the left adjacent to the upper inboard bell crank is the upper outboard bell crank 28. It is positioned to somewhat face the operator (opposite of inboard bell crank). This bell crank is also journaled over the upper drive shaft, to link with the lower drive shaft bell crank. The bell crank construction as illustrated in FIG. 2 is of a two-piece design so that removal or adjustment can be facilitated without disassembly of the drive shaft. The bell crank design incorporates serrations or knurled bore interior surface to maintain the desired clocked position on drive shaft(s).

On the lower drive shaft 20, is the lower drive shaft bell crank 25. This bell crank is placed in the same lateral position as the upper outboard bell crank. It faces the same direction as the upper outboard bell crank and has a typical but slightly shorter linkage system than the pedal link assembly. Together and when properly adjusted, the pedal (primary) is pressed down, the upper beater 30 rotates aft (toward the operator) and the lower beater 31 rotates toward the drumhead to strike. When the pedal is raised upward, the opposite action occurs.

The beaters are attached to the drive shafts by the use of fittings that are of two-piece design as shown in FIG. 3. They feature a splined or serrated interior bore that correspond to a section on each drive shaft that also has this feature. It prevents unwanted movement of beater position when adjusted to the desired effect/placement. The beaters can be positioned on the drive shaft(s) to strike the center/off center of the drumhead on a vertical placement or lateral (side-to-side) placement or any combination thereof.

To further enhance the performance and speed of operation, the primary pedal incorporates a toe strap/brace 32. It is an adjustable fixture that allows the operator's foot to slide in or out at will. This feature allows the operator to raise the pedal's upstroke faster and with an almost equal force as the down stroke. The operator can change/enhance the note projection as desired by increasing/decreasing the applied up or down force. The operator can change position to another pedal/secondary pedal by simply sliding his/her foot slightly backward.

To further increase performance, (although not necessarily required because of the toe strap system), biasing springs 33 are placed just outboard of each right and left post. Adjustable post spring brackets 34 anchor the bottom end of the springs via an adjustment post 35 that is inserted through a hole on the brackets extensions. The posts shank is threaded and is locked in a desired position by two jam nuts placed above and below the bracket extension. The upper end of the springs are anchored to spring bell cranks that are journaled over the ends of the upper drive shaft. They are of the same design as the linkage bell cranks with the exception of elongation slots. They can be biased opposite of each other or a variation that suits the operator.

For added flexibility, this invention features a single basic secondary pedal 4 of a more conventional design that can be placed to the right or left of the primary pedal as desired. It has the same type of hardware as the primary system with the exception of shorter linkage and drive shaft that spans only halfway between the posts. Together with the primary system of the adjustable cross member, upper/lower drive shafts, pedals and linkages, this will allow the assembly to be adjusted to various drum diameter size and pedal configuration. With this design, an additional drum and pedals can be utilized as required for even more desirable effect(s).

Figure 1:
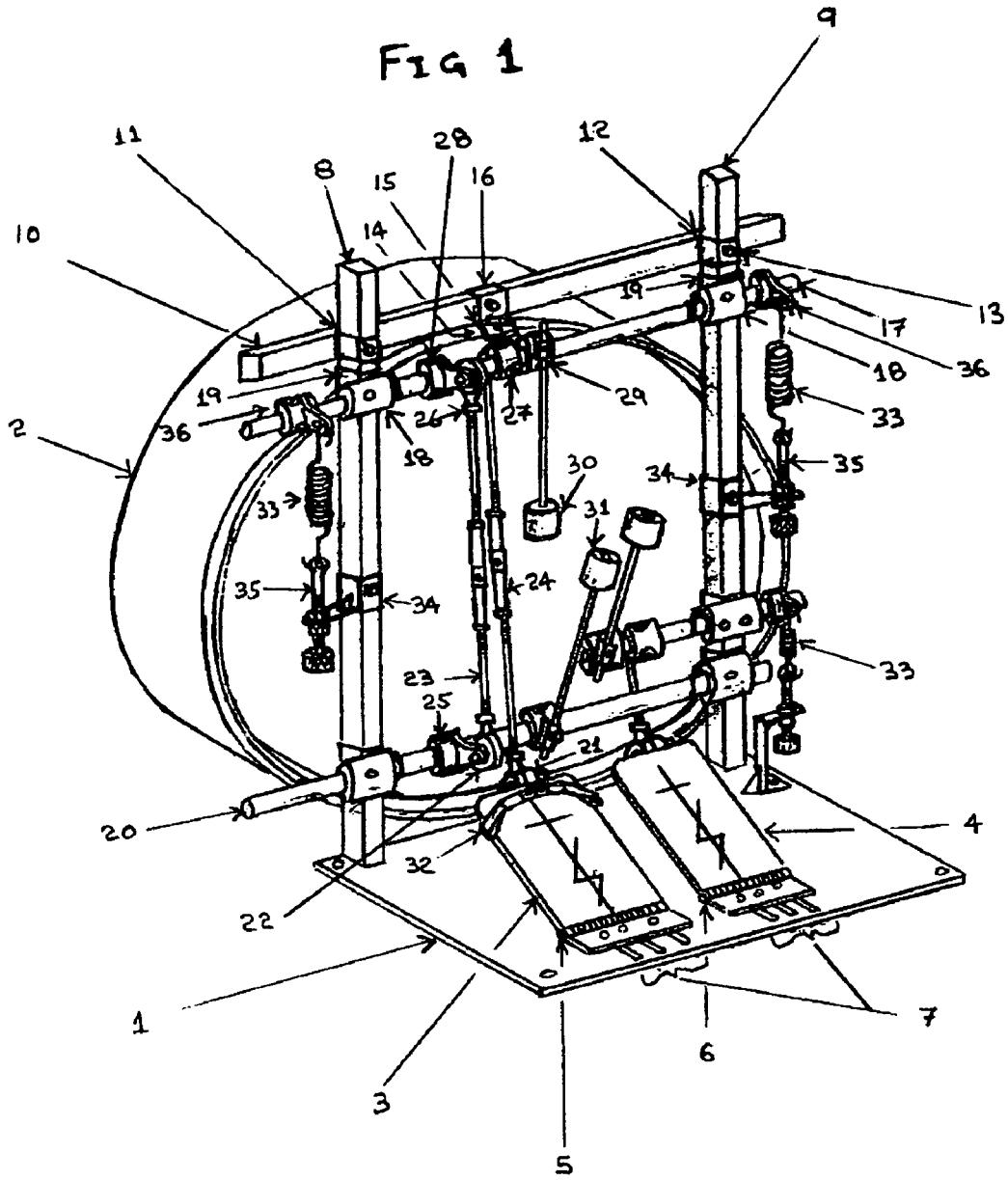
FIG. 1 is an operator's angular perspective view.
Figure 2:
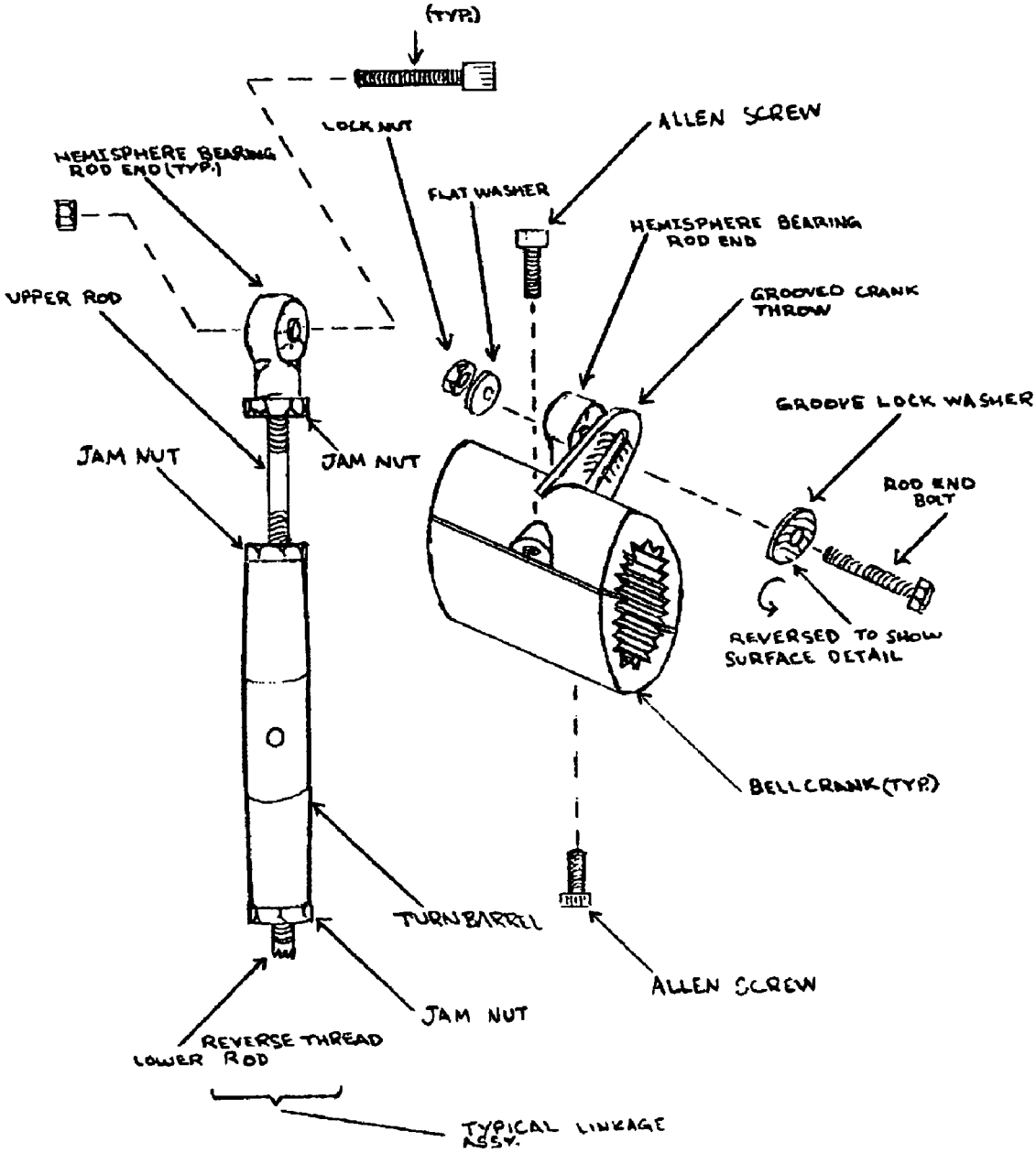
FIG. 2 shows details of a typical linkage assembly, typical drive link and bell crank.
Figure 3:
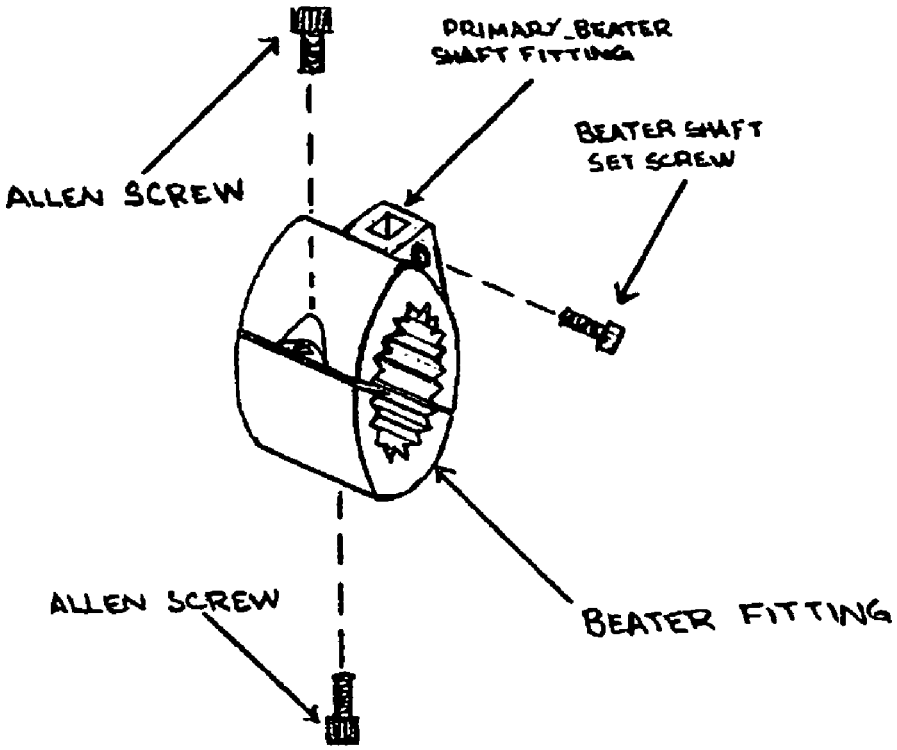
FIG. 3 shows detail of the (typical) beater shaft fitting.

I claim:

1. A drum pedal assembly comprising a base plate adapted to rest on the floor, and having a forward end and an opposed aft end, said forward end being adapted to be positioned in proximity to a drum head, a foot pedal having a forward extremity and a rear extremity, the rear extremity being pivotally connected to in proximity to the aft end of said base plate so that the forward extremity of the pedal can be pushed up and down by foot pressure a pair of parallel, spaced-apart vertical posts extending upwardly in from said base place in proximity to said forward end a horizontal cross-member carried by said pair of vertical posts near their upper extremity and secured to said posts a pair of parallel, spaced apart drive shafts rotatably carried on said posts, one said drive shaft being an upper shaft spaced in proximity to and below said cross-member and the other said drive shaft being a lower drive shaft carried in proximity to and above said base plate a beater carried by a rod affixed to each drive shaft means linking the forward extremity of said foot pedal to rotate said upper drive shaft as the forward extremity of said foot pedal is pushed up and down means linking the upper and lower drive shafts so that the lower drive shaft rotates as the upper drive shaft rotates said beaters being carried on said shafts such that one beater can strike the center of the drum head with the foot pedal in one position, and the other beater can strike the center of the drum head when the foot pedal is in a different position.

2. The drum pedal assembly of claim 1 wherein the forward end of the base plate is provided with means for clamping to a drum to positively but not permanently hold the drum in juxtaposition.

3. The drum pedal assembly of claim 1 wherein the base plate has provisions to affix it to the floor or a surface resting on the floor.

4. The drum pedal assembly of claim 1 further including an integral clamp system on the upper cross member to clamp the upper cross member to the drum.

5. The drum pedal assembly of claim 1 wherein the means linking comprise a set of push/pull rods composed of in order from bottom to top; a hemispherical bearing rod end joint internally threaded to a rod threaded into said joint and locked with a jam nut; a turn-barrel threaded onto the other end of rod extending upward locked by a jam nut; a rod threaded on the upper end of turn-barrel locked by a jam nut; a bell crank having a throw; and a hemispherical rod end joint attached to said bell crank throw.

6. The drum pedal assembly of claim 1 having two bell cranks on said upper drive shaft opposing each other and one on said lower drive shaft, said bell cranks having throws, with elongated holes within each throw, each throw having a multiple grooved surface to one side of throw and a corresponding grooved washer that is placed between each upper rod end and throw.

7. The drum pedal assembly of claim 1 further defined whereby the bell cranks are attached to said drive shafts by means that allows to 'clock' the bell crank to a desired position.

8. The drum pedal assembly of claim 1 having a bracing fixture for receiving at least part of the foot of the operator attached to the forward end of the foot pedal that allows said operator to lift the pedal upward.

9. The drum pedal assembly of claim 1 having a secondary pedal placed either to right/left of primary pedal for operation of an auxiliary beater.

10. The drum pedal assembly of claim 1 wherein said upper drive shaft is connected to biasing springs which connect to said posts to provide the drive shaft with a desirable degree of resistance to rotation.

11. The drum pedal assembly of claim 1 wherein said foot pedal is adjustable fore and aft with respect to said base plate.

12. The drum pedal assembly of claim 1 wherein the drive shafts are adjustably carried up and down on said posts.

* * * * *